United States Patent [19]

Quercetti

[11] Patent Number: 4,637,544

[45] Date of Patent: Jan. 20, 1987

[54] PROCESS FOR THE MANUFACTURE OF BOXES, THE BOXES WHICH RESULT THEREFROM AND THE ELEMENTS FOR THEIR COMPOSITION

[76] Inventor: Alessandro Quercetti, Strada S. Vito Revigliasco 48, I-10133 Torino, Italy

[21] Appl. No.: 687,286

[22] Filed: Dec. 28, 1984

[30] Foreign Application Priority Data

Jan. 13, 1984 [IT] Italy ..... 67027 A/84

[51] Int. Cl.[4] ..... B65D 5/66

[52] U.S. Cl. ..... 229/44 R; 229/23 R; 229/45 R; 27/7; 27/4; 493/84; 493/88; 493/102; 493/139; 493/909

[58] Field of Search ..... 27/1, 2, 3, 4, 7, 35; 229/43, 44 R, 44 CB, 34 R, 45 R; 493/84, 88, 102, 103, 137, 139, 308, 390, 909

[56] References Cited

U.S. PATENT DOCUMENTS

| | | | |
|---|---|---|---|
| 2,577,248 | 12/1951 | James | 229/43 |
| 2,990,998 | 7/1961 | Barclay | 229/43 |
| 3,050,817 | 8/1962 | Paré27 | 7/ |
| 3,365,113 | 1/1968 | Funkhouser et al. | 229/44 R |
| 3,487,991 | 1/1970 | Stern | 229/44 R |
| 3,935,991 | 2/1976 | Crane | 229/34 R |

*Primary Examiner*—Francis S. Husar
*Assistant Examiner*—David B. Jones
*Attorney, Agent, or Firm*—Young & Thompson

[57] ABSTRACT

A process for the manufacture of boxes, wherein a sheet material, such as cardboard, is punched to produce a box element with at least five sections limited by parallel score lines; the ends of at least three sections are inserted and fastened in U-grooves recessed in side walls formed by synthetic material, a fourth section forms a lowerable and liftable cover and a fifth terminal section forms a closing flap, for which each side wall of synthetic material has an insertion groove. The fastening of the punched element to the side walls may be carried out without adhesives by means of the engagement of the punched element edges, and of cuts thereof, in the U-grooves of the side walls, and with some teeth of them. Some side flaps defined in the closing flap can co-operate with inwardly and outwardly directed teeth of the insertion grooves, by providing for the cover in closed position a releasable catch and, respectively, a sealed closing.

24 Claims, 6 Drawing Figures

PROCESS FOR THE MANUFACTURE OF BOXES, THE BOXES WHICH RESULT THEREFROM AND THE ELEMENTS FOR THEIR COMPOSITION

BACKGROUND OF THE INVENTION

This invention has for its object a process for the manufacture of boxes. It also concerns the boxes resulting from this process, as well as the characteristic elements which serve for the formation of these boxes.

The manufacture of boxes of higher quality is expensive because of the need to apply adhesive to the punched elements, which complicates the equipment and makes the working times longer. Moreover the opportunity of forwarding the boxes to the place of utilization in a flattened shape in order to reduce the volume, obliges one to adopt specific structures, which not always correspond to the qualities wished for the boxes and, at the place of utilization, needs manual operations or rather complicated equipment for unfolding the boxes. Particularly, by these techniques it is not possible to satisfactorily manufacture boxes, i.e. boxes equipped with a liftable and lowerable cover forming one of the box major faces. Furthermore, with the known techniques, difficulties are met with in realizing effective catches to retain the cover in closed position, suitable for being easily neutralized for the box opening, and/or closing catch means having the character of a seal, which one can open only by tearing.

BRIEF SUMMARY OF THE INVENTION

The purpose of the present invention is to provide a process for the manufacture of boxes, which improves the industrial utilization and manufacturing operations of the box and further enables, in those cases in which it is desired, the total elimination of the adhesive operations and the provision of closing catch means suitable for being opened and/or having a seal character.

This object is attained, according to the invention, by a process which includes the operations of:

predisposing a punched element composed of a flexible sheet material having impressed thereon at least four score lines, parallel to each other and perpendicular to two opposite sides of the punched element, which results in an element thus subdivided in at least five sections;

predisposing two side walls formed by synthetic material, each of which has, recessed in a face, a first U-groove having branches of lengths corresponding, in the same order, to the distances between four successive said score lines from the preceding score line or from the initial edge of the punched element, and additionally has a second substantially rectilinear groove, parallel and closely disposed on the outside of one of the two parallel branches of the first U-groove;

bending the punched element sections along the score lines, thus giving the punched element the general shape of the box to be realized, open and lacking the side walls;

and inserting and fastening the ends of at least three of the bent punched element sections in the corresponding branches of said U-grooves of the two side walls;

two sections of the punched element thus remaining free with respect to the side walls, one of them forming a lowerable and liftable cover and the other, being a terminal one, forming a closing flap to be inserted in said second groove of the side walls.

Thanks to these characteristics, the punched element may be easily and economically produced, it may be supplied in unfolded form for use and is easy to bend, by hand or by simple equipment, thanks to the bending lines defined by the parallel score lines; the side walls may be easily and economically produced in the desired forms by molding or injection of plastics and they also may be supplied for use in compact ensembles of small volume; and the insertion of the section ends of the bent punched element in the corresponding side wall grooves is an operation which may be easily carried out and organized either manually or by simple reliable automatic equipment.

The fastening of the section ends in the U-grooves may be carried out, when this does not represent a drawback, by means of adhesive, but it may advantageously be carried out by means of irreversible mechanical engagement of configurations of the punched element edges and of the U-grooves of the side walls, thus avoiding any adhesive. Finally, opportune, simple configurations of the side flaps of the section forming a closing flap, and of the corresponding insertion grooves of the side walls, provide effective catch means in the closed position of the cover, to be easily opened and/or forming a seal.

BRIEF DESCRIPTION OF THE DRAWINGS

These and other characteristics of the invention will appear more clearly from the following description of an embodiment of the invention, having the non-restrictive character of an example, diagrammatically shown in the appended drawings, in which.

DETAILED DESCRIPTION OF THE PREFERRED EMBODIMENT

Figure 1:
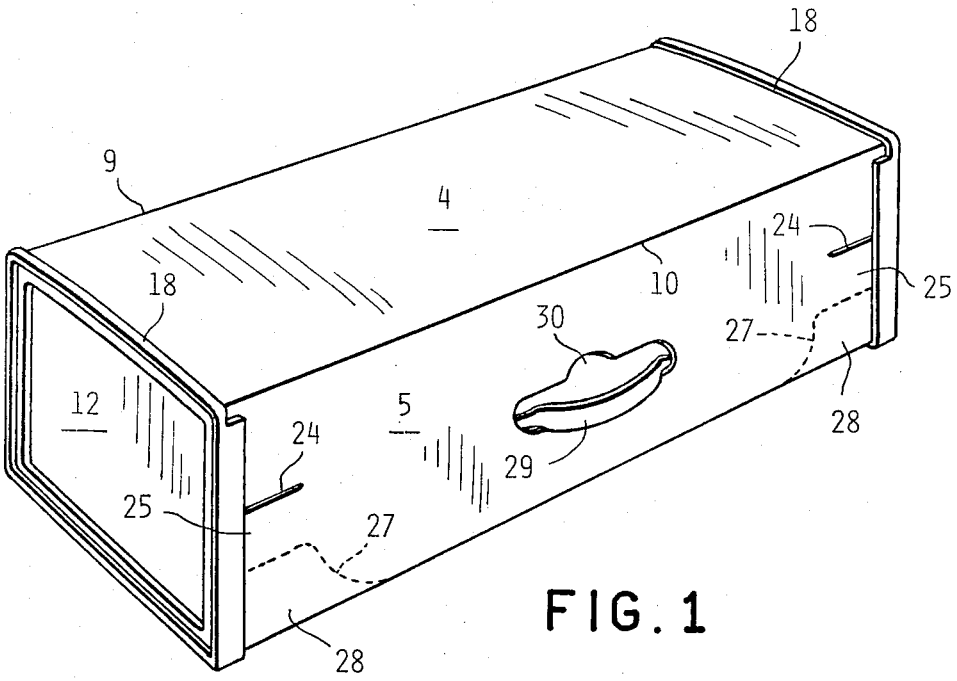
FIG. 1 shows, on a small scale, a box according to the invention, in closed condition.
Figure 2:
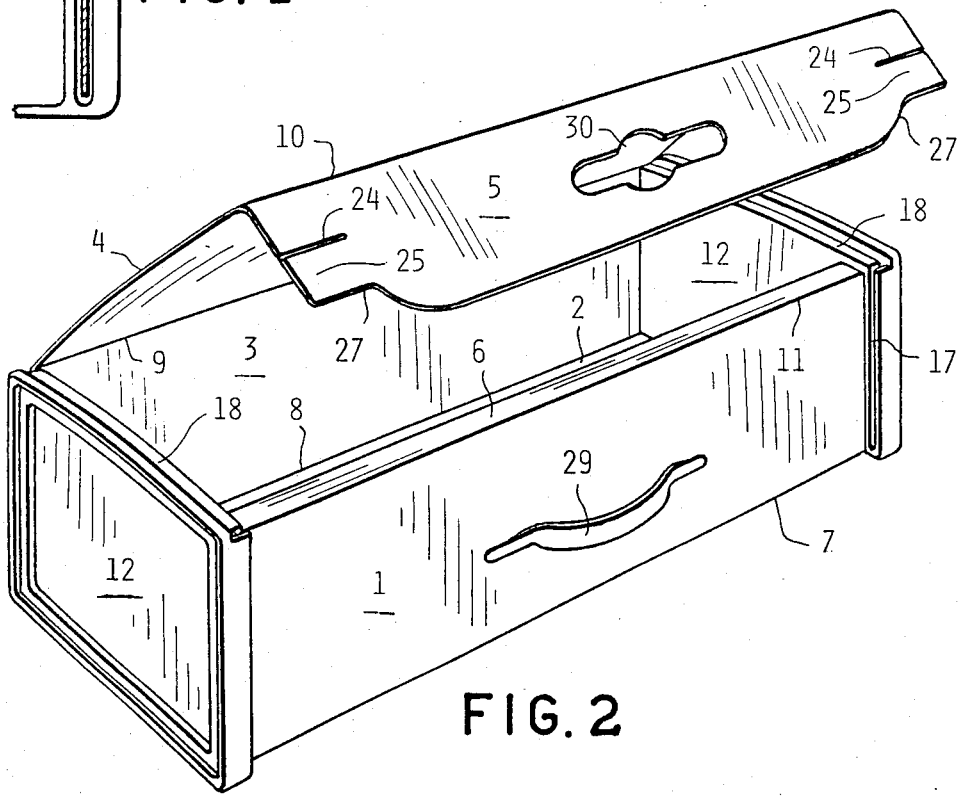
FIG. 2 shows the same box of FIG. 1, but in open condition after the tearing of seals.

The punched element intended to form the box in accordance with FIGS. 1 and 2 has a substantially rectangular shape and is mainly comprised by five sections: 1 forming the box front; 2 forming the bottom; 3 forming the back; 4 forming the liftable and lowerable cover; and 5 forming a closing flap. In the represented form, the punched element further has a sixth narrow section 6, intended to form an inwardly bent flap at the box opening, particularly to stiffen the front 1. These sections, of rectangular shape, are separated from each other by score lines, respectively 7, 8, 9, 10 and 11. The punched element 1–6 may be realized in any rather flexible sheet material, such as cardboard, cardboard coupled with plastic and/or metallic laminate, thin metal plate, laminated plastic material and so on.

Each of the side walls intended to form the box in combination with the punched element 1–6 has—in this case—a substantially rectangular shape, along three sides of which (front, bottom and rear sides) extend the three branches 13, 14, 15 of a U-groove recessed in that face of the side wall 12 which is intended to be disposed inside the box. In the shown form, the rear branch 15 of the U-groove is open at top, whereas the front branch 13 is connected at the top end to a short groove section 16, substantially parallel to the lower branch 14. The respective lengths of these groove branches 13 to 16 correspond, in the same order, to the widths of the sections, 1, 2, 3 and 6 of the punched element 1–6, measured between the score lines which limit each of them or (as far as the section 6 is concerned) between the score line 11 and the edge which limits the punched element.

Moreover, each side wall 12 has along the front side a second, rectilinear groove 17, parallel to and outside the front branch 13 of the U-groove, said groove 17 being open at top.

At the time and place of the box assembly—which may be different from the time and place of manufacture of the components—the punched element 1–6 is bent along the score lines 7–11, thus giving it substantially the form shown in FIG. 2, and then both opposite edges thereof are inserted in the U-grooves 13–16 of the side walls 12 and are fastened therein; by this operation, the box is assembled, open and ready for being filled with the articles to be contained. For closing the box, the cover 4 is lowered until it contacts the top side 18 of the side walls 12, while inserting the side edges of the closing flap 5 in the second groove 17 of the side walls 12. The box, so filled and closed, may be sealed in any way and forwarded to the further operations.

For a more perfect closing of the cover 4, the top side 18 of the side walls 12 is preferably curved with a slight convexity towards the outside, so that, when the box is closed, the cover 4 will be slightly curved too.

Figure 3:
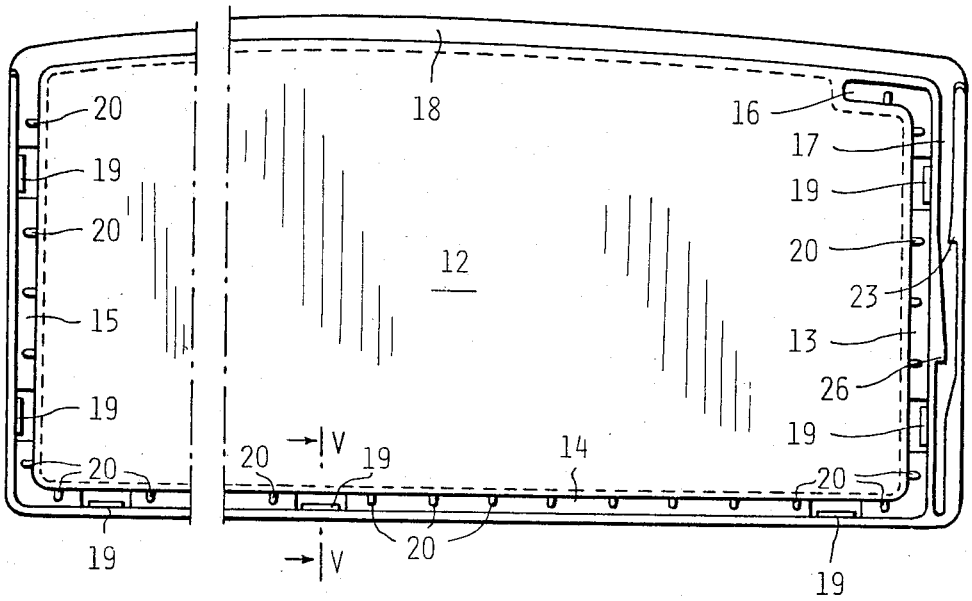
FIG. 3 illustrates partially, on a larger scale and as viewed from the face intended to be positioned inside the box, one of the side walls.
Figure 5:
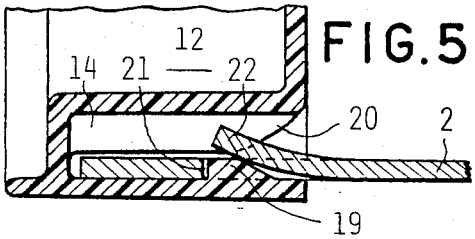
FIG. 5 illustrates, on a very enlarged scale, a partial section taken along line V—V of FIG. 3, with the bent punched element inserted in the side wall and hooked therein.
Figure 6:
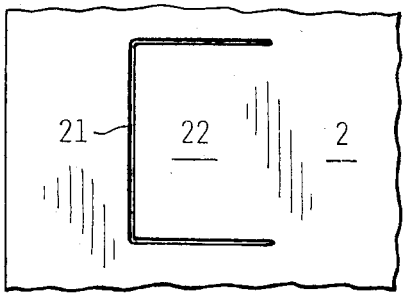
FIG. 6 illustrates the form of the cuts carried out in the punched element in order to realize the hooking shown in FIG. 5.

A very advantageous means for fastening the punched element 1–6 with the side walls 12 is shown in FIGS. 3, 5 and 6. One of the walls of the branches 13 to 15 (and if needed of the branch 16 too) of the U-grooves of the side walls 12 shows spaced teeth 19, whereas projections 20 extend, at a certain distance from the teeth 19, from the opposite groove wall. In the points of the edges of the punched element 1–6, which correspond to the teeth 19, cuts 22 in C-form are made, as indicated in FIG. 6; each of them defines a resiliently liftable flap 22. When the punched element edges are inserted in the U-grooves of the side walls, the flap 22 is kept lightly raised by the corresponding tooth 19, whereas the lateral projections 20 keep the cut edge 21 surely engaged with the tooth 19, as shown in FIG. 5. With this arrangement, the insertion of the punched element edges in the U-grooves of the side walls gives rise to an irreversible mechanical engagement which definitively fastens the side walls and the box walls together.

Preferably, the lateral projections 20 are not provided on both sides of each tooth 19 only, but they are also regularly spaced along all the corresponding wall of the U-groove and have a length chosen in such a manner that the punched element edge is inserted with a certain constraint between each said projection and the opposite wall of the U-groove. In this way, an effective mutual immobilization between side walls and punched element is obtained, thus giving the box a particular stiffness, especially when it is in its open condition.

Figure 4:
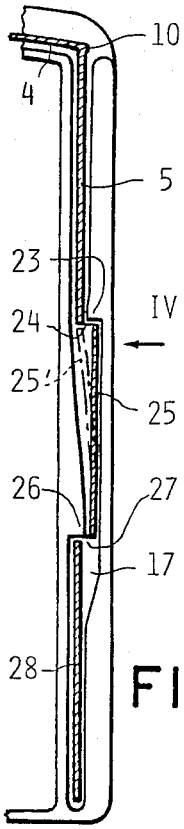
FIG. 4 shows, on a still larger scale, a detail of the second groove of a side wall, with the indication of the section of the closing flap of the bent punched element, inserted therein.

It is furthermore advantageous that the second groove 17 of the side walls 12 presents an inward tooth 23, whereas corresponding cuts 24, of limited length, define along the lateral edges of the closing flap 5 of the box two little flaps 25 which, at the time of closing the box, engage beneath the teeth 25 of the side walls grooves 17, as shown in FIG. 4, thus reliably keeping closed the box. However, it is enough to exert a pressure from the outside on the flaps 25, according to the arrow IV of FIG. 4, to elastically deform the flaps 25 by moving them to 25' (FIG. 4), then permitting the opening of the box. The flaps 25 form a permanent system of closing suitable for being opened, to be utilized indefinitely in the further box use.

If it is desirable that the box may be sold in a sealed condition, a second tooth 26, this one outwardly directed, may be formed in the groove 17 beneath the tooth 23 (if this latter has been provided), whereas a line of tearing 27 isolates from the box closing flap 5 corresponding little flaps 28 to be torn. These latter engage beneath the tooth 26 of the groove 17 thereby positively preventing the box from opening. To open the box, it is necessary to apply a force sufficient to tear the flaps 28, which are then detached from the closing flap 5 thus permitting opening the box. However, the box of FIG. 2 shows that it has been opened since it lacks the flaps 28, which therefore form guarantee seals.

A handle of flexible plastics 29 may be applied to the front 1 of the box, and may be accessible through a slit 30 of the closing flap 5, thus permitting the box to be transported like a suit case and ensuring that the box remains closed during transport. This closing and transport means can replace the flaps 25 or integrate the action thereof.

As will be understood, the application of the invention is not limited to substantially parallelepipedal boxes, such as that exemplified; the main box walls, and therefore the side walls sides, may be in a number different from four and such walls may also be curved, so that the box may assume any prismatic shape and even partially or completely cylindrical form.

The cooperating configurations of the U-groove and of the punched element edges, intended to mutually cooperate for realizing an irreversible engagement, may be changed with respect to those illustrated by way of example and, as the box closing means, conventional means, such as hooks, push-buttons and so on, may be adopted instead of the originally described arrangement.

In addition, in those cases in which an adhesive operation is not considered a drawback, or in any way it is desired to make use thereof, the fastening of the punched element edges in the U-groove of the side walls may be realized by a bonding agent, while the process according to the invention remains however advantageous in that it simplifies the punched element configuration and the operations for bending the same at the time of the box assembly.

The modifications indicated, and others, as well as any replacement by technically equivalent means, may be applied to what has been described and illustrated, without departing from the spirit of this invention.

I claim:

1. A process for the manufacture of boxes, including the operations of:

predisposing a punched element composed of a flexible sheet material having impressed thereon at least four score lines parallel to each other, perpendicular to two opposite sides of said punched element and subdividing said punched element in at least five sections;

predisposing two side walls formed by synthetic material, each said side wall having, recessed in a face, a first U-groove having branches of lengths corresponding, in the same order, to the distances of four successives of said scores lines from the preceding score line or from the initial edge of the punched element respectively, and additionally having a second substantially rectilinear groove, parallel to and closely disposed on the outer side of one of the branches of said first U-groove;

bending said punched element sections along said score lines, thus giving the punched element the general shape of the box to be produced, open and still lacking the side walls;

and inserting and fastening the ends of at least three of said bent punched element sections in the corresponding branches of said U-grooves of the two side walls;

whereby two sections of the punched element remain free with respect to the side walls, one of them forming a lowerable and liftable cover and the other, being a terminal one, forming a closing flap to be inserted in said second groove of the side walls.

2. A process as set forth in claim 1, further including the operations of:

predisposing, in forming said side walls, some teeth and projections, protruding in said U-groove and forming hooking means;

predisposing, along the punched element edges, some cuts corresponding to said teeth of the U-groove of the side walls; and fastening the bent punched element U-grooves of the side walls by causing the engagement of said cuts of the punched element with said teeth of the U-grooves of the side walls.

3. A process as set forth in claim 1, further including the operations of:

predisposing, in forming said sides, some projections protruding in said U-groove, regularly spaced along the groove; and inserting said bent punched element in the U-grooves of the side walls with a certain constraint between each said projection and the opposite U-groove wall.

4. A process as set forth in claim 1, further including the operations of:

predisposing in said second groove of the side walls a tooth directed inwardly and towards the adjacent branch of the first U-groove;

predisposing in the terminal section of the punched element two cuts of limited length, starting from both opposite sides of the punched element; and effecting the stable and openable closing of the box by inserting the terminal section of the punched element in said second groove of the side walls and by hooking the flaps defined by said cuts with the inwardly directed tooth of the second groove of the side walls;

whereby said flaps may be released from said inwardly directed teeth, to open the box, by a pressure exerted thereon from the outside.

5. A process as set forth in claim 1, further including the operations of:

predisposing in said second groove of the side walls an outwardly directed tooth;

predisposing in said terminal section of the punched element at least one tearing line ending on both opposite sides of the punched element; and effecting the tearable sealed closing of the box by inserting the terminal section of the punched element in said second groove of the side walls and by hooking the flaps defined by said tearing line with said outwardly directed teeth of the second groove of the side walls;

the box opening involving tearing the seals formed by said flaps defined by the tearing line.

6. A box comprising: a punched element of a flexible sheet material having at least five sections and at least four parallel score lines separating said five sections, said punched element being bent along said score lines; and two side walls formed of synthetic material, each side wall having a first U-groove including at least three branches, and a second groove parallel to and closely disposed on the outer side of one of the branches of said first U-groove; the end edges of at least three of said sections of the punched element being firmly engaged in corresponding branches of said first U-grooves of the two side walls, a fourth section forming a lowerable and liftable cover, and the terminal section being adapted to be inserted in, and extracted from, said second groove of the two side walls, to close and to open the box.

7. A box as set forth in claim 6, wherein said end edges of the punched element sections have some cuts, said first grooves of the side walls have some teeth corresponding to said cuts of the punched element sections, and said end edges of the punched element sections are engaged in said first U-grooves of the side walls by irreversible engagement of said cuts presented by the edges of the punched element sections with said teeth presented by said first grooves of the side walls.

8. A box as set forth in claim 7, wherein said U-grooves of the side walls have, at the side opposite said teeth and at a certain distance from said teeth in a lateral direction, some projections, said projections ensuring the engagement of said cuts of the punched element section edges with the teeth of said first U-grooves of the side walls.

9. A box as set forth in claim 6, wherein said U-grooves of the side walls have regularly spaced projections, said projections ensuring a rather forced engagement of said punched element section edges with said first U-grooves of the side walls.

10. A box as set forth in claim 6, wherein each said second groove of the side walls has an inwardly directed tooth, and said terminal section of the punched element has at each side edge a catch flap and a cut delimiting said catch flap, said catch flaps being adapted to engage said inwardly directed teeth, thus realizing a retention of the cover in its closed position, which can be released by a pressure exerted from the outside on said catch flaps.

11. A box as set forth in claim 6, wherein each said second groove of the side walls has an outwardly directed tooth, and said terminal section of the punched element has at each side edge a seal flap and a tearing line delimiting said seal flap, said seal flaps being adapted to engage said outwardly directed teeth, thus realizing a seal of the cover in its closed position, which can be opened only by tearing said seal flaps.

12. A box as set forth in claim 10, wherein each said second groove of the side walls further has an outwardly directed tooth, and said terminal section of the punched element further has at each side edge a seal flap and a tearing line delimiting said seal flap, said seal flaps being adapted to engage said outwardly directed teeth, thus realizing a seal of the cover in its closed position, which can be opened only by tearing said seal flaps, said inwardly directed tooth of each second groove of the side walls lying, with respect to said outwardly directed tooth, closer to that end of the second groove to which corresponds the score line linking said terminal section of the punched element to the adjacent section.

13. A box as set forth in claim 6, wherein the sides of said side walls, opposite the intermediate branch of said U-groove, have a convex curvature.

14. A box as set forth in claim 6, wherein said punched element has a narrow sixth section, and each said U-groove of the side walls has a terminal portion extending towards the inside of the box from that branch of the U-groove which is adjacent to said second groove, the end edges of said sixth section of the punched element being inserted in said terminal portion of said U-grooves of the side walls.

15. A punched element of a flexible sheet material, for the formation of a casket box, which has at leat four score lines parallel to each other and perpendicular to two opposite sides of the punched element, and at least five sections delimited by said score lines, said sections being adapted to form three main box walls, a lowerable and liftable cover and a closing flap, said elements being free from score lines transverse to said parallel score lines, said closing flap having two tearing lines extending from its opposite edges, and two seal flaps delimited by said tearing lines, said seal flaps being adapted to retain the cover in its closed position, and to be released only by tearing.

16. A punched element as set forth in claim 15, wherein said closing flap has two cuts, extending for a limited length from its opposite edges, and two catch flaps delimited by said cuts, said catch flaps being adapted to releasably retain the cover in its closed position.

17. A punched element as set forth in claim 15, wherein said two opposite sides of the punched element have spaced hooking cuts.

18. A punched element as set forth in claim 15, which has a sixth section adapted to form an internal stiffening flap at the box opening.

19. A side wall of synthetic material for the formation of a casket box, which has along at least three sides a first U-groove having three branches, recessed in a face of said side wall, and has a second groove parallel to and closely disposed on the outer side of one of the branches of said first U-groove.

20. A side wall as set forth in claim 19, wherein said first U-groove has spaced inwardly directed retention teeth and, at a certain distance from said teeth in lateral direction, some projections which protrude from the side of the groove opposite to said teeth.

21. A side wall as set forth in claim 19, wherein said first U-groove has regularly spaced projections, protruding from one of its walls towards the opposite wall and ending at a certain distance from said opposite wall.

22. A side wall as set forth in claim 19, wherein said second groove has an inwardly directed releasable retainment tooth.

23. A side wall as set forth in claim 19, wherein said second groove has an outwardly directed sealing tooth.

24. A side wall as set forth in claim 19, having its side opposite to the intermediate branch of said U-groove curved with outwardly directed convexity.

* * * * *